US008089446B2

(12) United States Patent
Pak et al.

(10) Patent No.: US 8,089,446 B2
(45) Date of Patent: Jan. 3, 2012

(54) DISPLAY DEVICE CAPABLE OF DISPLAYING PARTIAL PICTURE AND DRIVING METHOD OF THE SAME

(75) Inventors: Sang-jin Pak, Yongin-si (KR); Myung-woo Lee, Seoul (KR); Hyung-guel Kim, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 1168 days.

(21) Appl. No.: 11/895,100

(22) Filed: Aug. 22, 2007

(65) Prior Publication Data

US 2008/0055225 A1 Mar. 6, 2008

(30) Foreign Application Priority Data

Sep. 1, 2006 (KR) ..... 10-2006-0084337

(51) Int. Cl.
*G09G 3/36* (2006.01)

(52) U.S. Cl. ..... 345/100

(58) Field of Classification Search ..... 345/100
See application file for complete search history.

(56) References Cited

U.S. PATENT DOCUMENTS

| | | | | |
|---|---|---|---|---|
| 5,881,299 | A * | 3/1999 | Nomura et al. | 713/324 |
| 7,283,603 | B1 * | 10/2007 | Chien et al. | 377/64 |
| 7,372,445 | B2 * | 5/2008 | Takahashi et al. | 345/100 |
| 7,522,148 | B2 * | 4/2009 | Maki | 345/100 |
| 7,639,245 | B2 * | 12/2009 | Shimizu et al. | 345/204 |
| 2002/0175887 | A1 * | 11/2002 | Yamazaki | 345/87 |
| 2004/0027364 | A1 * | 2/2004 | Ohtani et al. | 345/699 |
| 2004/0189585 | A1 * | 9/2004 | Moon | 345/100 |
| 2004/0217935 | A1 * | 11/2004 | Jeon et al. | 345/100 |
| 2006/0227094 | A1 * | 10/2006 | Park et al. | 345/100 |

FOREIGN PATENT DOCUMENTS

| | | |
|---|---|---|
| JP | 2005-37849 | 2/2005 |
| KR | 2003-0051391 | 6/2003 |
| KR | 2003-0056685 | 7/2003 |

OTHER PUBLICATIONS

English Language Abstract, Publication No. JP2005037849, Feb. 10, 2005, 1 p.
Korean Patent Abstracts, Publication No. 1020030051391, Jun. 25, 2003, 1 p.
Korean Patent Abstracts, Publication No. 1020030056685, Jul. 4, 2003, 1 p.

* cited by examiner

*Primary Examiner* — Ke Xiao
(74) *Attorney, Agent, or Firm* — Innovation Counsel LLP

(57) ABSTRACT

Disclosed is a display device, including: a display substrate which comprises a gate line and a data line and a gate driving unit which is coupled to the gate line of the display substrate and outputs a gate signal. The gate driving unit is comprised of a shift register that includes a plurality of stages. At least one of the stages comprises a first drive controller that generates a first control signal by a carry signal applied from a previous stage, a second drive controller that generates a second control signal by a reset signal applied from a subsequent stage, a first drive unit that outputs the reset signal and the carry signal to the previous stage and the following stage, respectively by the first control signal and the second signal, and a second drive unit that outputs the gate signal to the gate line by the first control signal and the second signal.

9 Claims, 10 Drawing Sheets

DISPLAY DEVICE CAPABLE OF DISPLAYING PARTIAL PICTURE AND DRIVING METHOD OF THE SAME

CROSS-REFERENCE TO RELATED APPLICATIONS

This application claims priority from Korean Patent Application No. 10-2006-0084337, filed on Sep. 1, 2006 in the Korean Intellectual Property Office, the disclosure of which is incorporated herein by reference.

BACKGROUND OF INVENTION

1. Field of Invention

Apparatuses and methods consistent with the present invention relate to a display device and a driving method of the same, and more particularly, to a display device capable of displaying a partial picture and a driving method of the same.

2. Description of the Related Art

A liquid crystal display device as one of a flat panel display device generally includes a display panel having a plurality of gate lines and a plurality of data lines vertically intersecting the plural gate lines; a gate driving unit coupled to the gate lines and to apply a gate signal to the gate lines; and a data drive unit to be synchronized with the gate signal and to apply a data signal to the data lines.

Conventionally, the gate driving unit and the data driving unit provided as a chip type are generally mounted onto a printed circuit board (PCB) coupled to the display panel. Alternatively, the gate driving unit and the data driving unit provided as the chip type are directly mounted onto the display panel. However, if the gate driving unit does not require the speed of a thin film transistor (TFT) channel, the gate driving unit does not need to be separately formed as the chip type. Instead, a present day display panel employs a display cell array formation process using an amorphous silicon gate structure. Here, in the display cell array formation process, an amorphous silicon TFT is formed on a display panel substrate, and the amorphous silicon gate structure is adopted indicating a structure to form the amorphous silicon TFT on the display panel substrate and to form the gate driving unit on the peripheral area of the display simultaneously.

The gate driving unit using an amorphous silicon gate structure generally includes a plurality of stages sequentially coupled thereto and a shift register having signal lines coupled to the plural stages. The respective stages are coupled one-to-one to the corresponding gate lines, and output the gate signal to the gate lines. That is, since the plural stages are sequentially coupled to the drive gate and are driven together, even though a screen includes a non-display section, display information is continuously updated on a whole area of the screen, thereby consuming an unnecessary amount of power. Accordingly, there have been many suggestions for an amorphous silicon gate drive gate capable of partially being driven. However, it has not been easy to form the non-display area having a desired size on a desired position, or to improve the quality and driving properties of the amorphous silicon gate drive gate.

SUMMARY OF THE INVENTION

Accordingly, it is an aspect of the present invention to provide a display device and a driving method of the same, which includes a reliable gate drive circuit having a driving property capable of being partially driven, and forming a non-display area having a desired size on a desired position.

Additional aspects of the present invention are set forth in the description which follows.

The foregoing and other aspects of the present invention can be achieved by providing a display device, comprising: a display substrate which comprises a gate line and a data line; and a gate driving unit which is coupled to the gate line of the display substrate and outputs a gate signal; the gate driving unit comprising a shift register that comprises a plurality of stages; and at least one of the stages comprises a first drive controller that generates a first control signal by a carry signal applied from a previous stage, a second drive controller that generates a second control signal responsive to a reset signal received from a following stage, a first drive unit that outputs the reset signal to the previous stage and the carry signal to the following stage in response to the first control signal, the second control signal and a clock signal, and a second drive unit that outputs the gate signal to the gate line responsive to the first control signal, the second signal and a partial clock signal.

According to an aspect of the invention, the first drive controller includes a control port adapted to receive the carry signal from the previous stage; and an output port which is adapted to provide the first control signal responsive to receipt of the carry signal.

According to an aspect of the invention, the first drive controller comprises a control port to which the carry signal is applied from the previous stage; an input port coupled to the control port, is coupled, and an output port which outputs the carry signal applied to the input port by the carry signal applied to the control port as the first control signal.

According to an aspect of the invention, the second drive controller comprises an input port into which a gate off voltage is inputted, a control port to which the reset signal is applied from a following stage, and an output port which outputs the gate off voltage inputted into the input port by the reset signal applied to the control port as the second control signal.

According to an aspect of the invention, the first drive unit comprises a first pull-up drive unit which generates a carry signal of high level and a reset signal of high level, and a first pull-down drive unit which generates a carry signal of low level and a reset signal of low level.

According to an aspect of the invention, the first pull-up drive unit comprises an input port into which a clock signal is inputted, a control port to which the first control signal and the second control signal are applied, and an output port which outputs the clock signal inputted into the input port by the first control signal and the second control signal applied to the control port as the carry signal of high level and the reset signal of high level.

According to an aspect of the invention, the first pull-up drive unit further comprises a first capacitor which is provided between the control port and the output port, and allows the control port to be bootstrapped and the first control signal to be maintained for a predetermined period of time.

According to an aspect of the invention, the first pull-down drive unit comprises an input port into which a gate off voltage is inputted, a control port to which an inversion clock signal is applied, and an output port which outputs the gate off voltage inputted into the input port by the inversion clock signal applied to the control port as the carry signal of low level and the reset signal of low level.

According to an aspect of the invention, the second drive unit comprises a second pull-up drive unit which generates a gate signal of high level in a display area and a gate signal of low level in a non display area, and a second pull-down drive unit which generates the gate signal of low level in the display area and the non-display area.

According to an aspect of the invention, the second pull-up drive unit comprises an input port into which a partial clock signal is inputted, a control port to which the first control signal and the second control signal are applied, and an output port which outputs the partial clock signal inputted into the input port by the first control signal and the second control signal applied to the control port as the gate signal.

According to an aspect of the invention, the second pull-up drive unit further comprises a second capacitor which is provided between the control port and the output port, and allows the control port to be bootstrapped and the first control signal to be maintained for a predetermined period of time.

According to an aspect of the invention, the second pull-down drive unit comprises an input port into which a gate off voltage is inputted, a control port to which an inversion clock signal is applied, and an output port which outputs the gate off voltage inputted into the input port by the inversion clock signal applied to the control port.

The foregoing and other aspects of the present invention can be also achieved by providing a driving method of a display device, comprising: providing a first drive controller for receiving a carry signal from a previous stage, the first drive controller being operative to generate a first control signal; operating a first pull-up drive unit to output a clock signal by the first control signal as the carry signal through a first output port, and a second pull-up drive unit to output a partial clock signal by the first control signal as a gate signal through a second output port; operating a second drive controller to receive a reset signal from a following stage and to generate a second control signal; and preventing the clock signal by the second control signal from being transmitted to the first output port and allowing a pull-down drive unit to output a gate off voltage to the first output port, and preventing the partial clock signal by the second control signal from being transmitted to the second output port and allowing a second pull-down drive unit to output the gate off signal to the second output port.

The foregoing and other aspects of the present invention can be also achieved by providing a changing method of a display screen, comprising: updating display information of a whole screen area in a full screen display mode; updating display information of a display area and display information of a non-display area for a predetermined frame in a partial screen display mode; updating the display information of the display area and calculating the number of accumulated frames in the partial screen display mode; and updating the display information of the non-display area by a polarity opposite to that of a previous one, if the calculated number of accumulated frames reaches a predetermined number in a partial screen display mode.

BRIEF DESCRIPTION OF THE DRAWINGS

The above and other aspects of the present invention will become apparent and more readily appreciated from the following description of the exemplary embodiments, taken in conjunction with the accompanying drawings, in which.

DETAILED DESCRIPTION OF THE INVENTION

Figure 1:
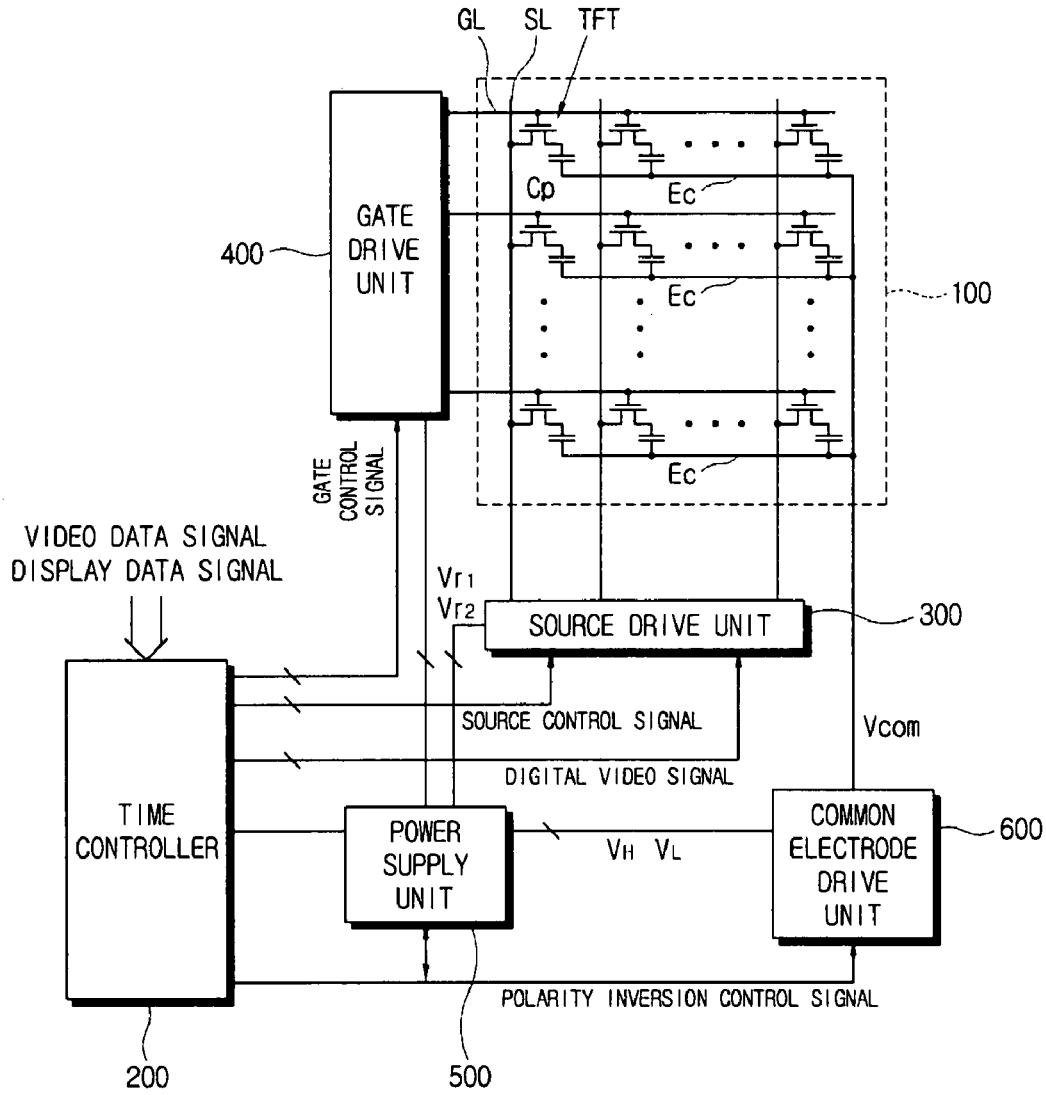
FIG. 1 is a schematic view illustrating a configuration of a display device according to a first exemplary embodiment of the present invention.

Reference will now be made in detail to the embodiments of the present invention, examples of which are illustrated in the accompanying drawings, wherein like reference numerals refer to like elements throughout. The embodiments are described below so as to explain the present invention by referring to the figures.

FIG. 1 is schematic diagram illustrating a configuration of a display device according to a first exemplary embodiment of the present invention.

Figure 2:
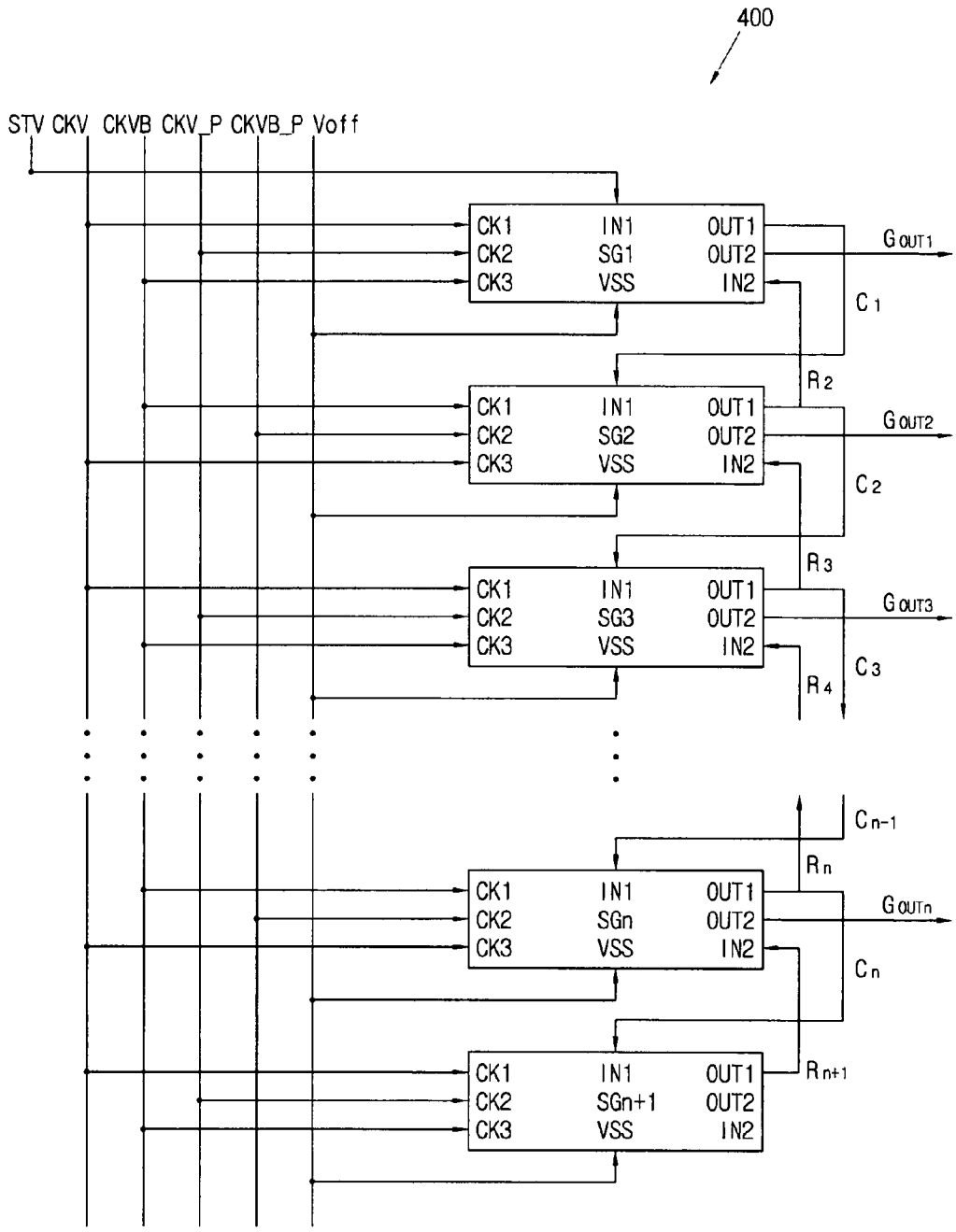
FIG. 2 illustrates a configuration of a gate driving unit in FIG. 1.
Figure 4:
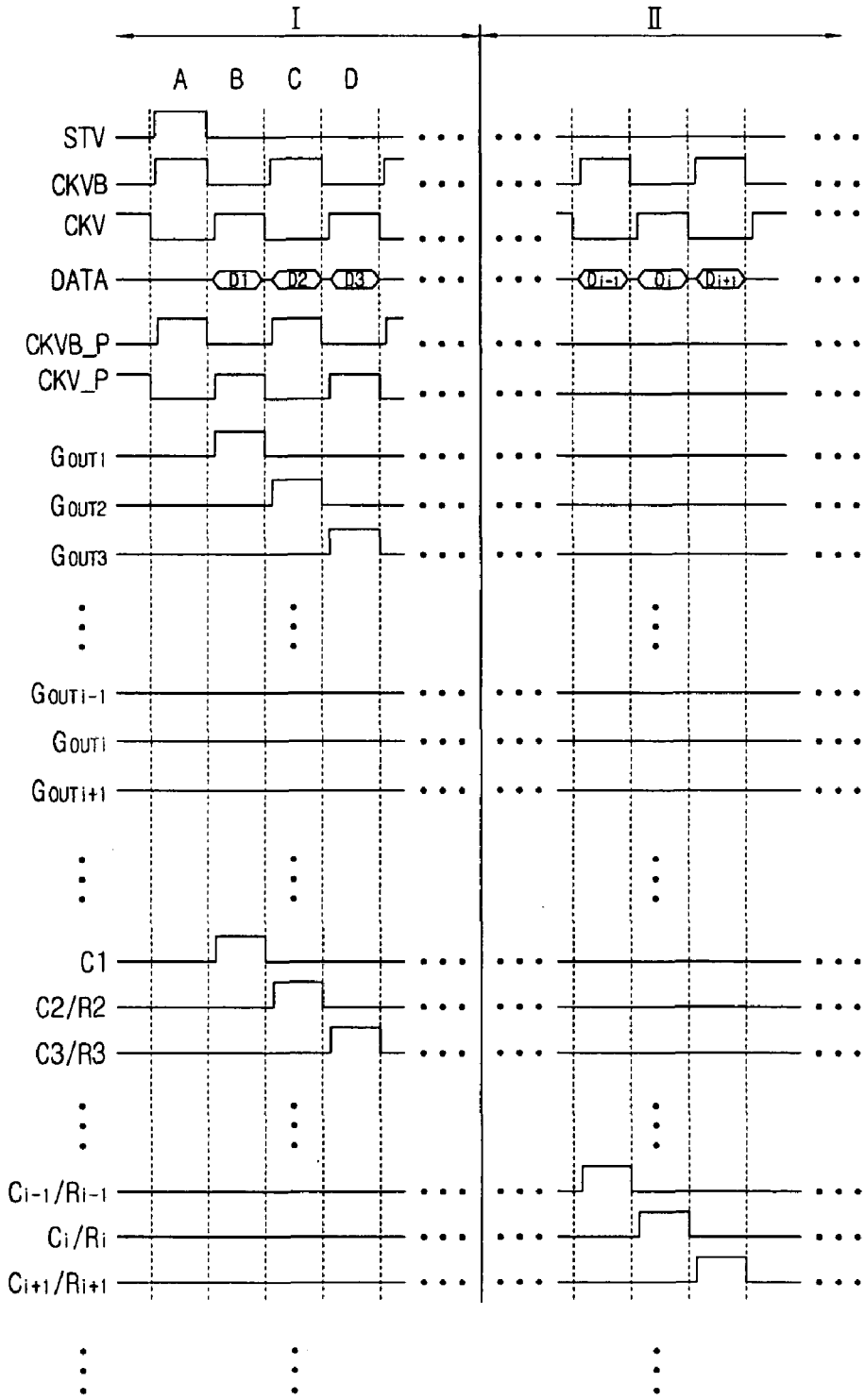
FIG. 4 is a timing diagram of signals inputted into a gate driving unit according to the first exemplary embodiment of the present invention.

Like a conventional liquid crystal display device, a liquid crystal device according to the first exemplary embodiment of the present invention includes a liquid crystal panel 100, a time controller 200, a source drive unit 300, a gate driving unit 400, a power supply unit 500 and a common electrode drive unit 600. The time controller 200 receives a video data signal and a display control signal, and outputs a gate control signal to the gate driving unit 400. As illustrated in FIGS. 2 and 4, the gate control signal may include partial clock signal CKV_P or partial inversion clock signal CKVB_P. the signals and timing of CKV_P and CKVB_P, respectively is described below. Other configurations and corresponding connecting relationships of the liquid crystal panel 100, the source drive unit 300, the power supply unit 500, and the common electrode drive unit 600 may be applied to the present invention with a conventional technology. Here, at least two elements among the time controller 200, the source drive unit 300, the gate driving unit 400, the power supply unit 500, and the common electrode drive unit 600 may be joined to each other as one chip.

A detailed configuration of the gate driving unit 400 according to the first exemplary embodiment of the present invention is described below referring to FIG. 2.

The gate driving unit 400 according to the first exemplary embodiment of the present invention includes n+1 stages SG1~SGn+1 and a shift register having a plurality of signal lines for a start vertical signal (STV), a clock signal (CKV), an inversion clock signal (CKVB), CKV_P, CKVB_P, a gate off voltage Voff, a carry signal Ci, a reset signal Ri, and a gate out signal Gouti inputted from or outputted to the stages SG1~SGn+1, where i may be any number between 1 and n. The n+1 stages include n drive stages SG1 through SGn and a dummy stage SGn+1. Here, n is natural numbers.

The respective stages SGi includes clock ports CK1, CK2, CK3, input ports IN1, IN2, output ports OUT1, OUT2, and a power port VSS. Here, "i" is an arbitrary natural number between 1 and a natural number n including 1 and n.

A connection of an odd number "j" stage SG among the n drive stage SGi will be described. Here, "j" is an arbitrary odd number between 1 and a natural number n including 1 and n. Further, if an element in each stage SGi has a same function, the respective elements have a same reference symbol and number as each other for a convenient description. In the SGj, a CK1 is coupled to a line for CKV, a CK2 is coupled to a line for CKV_P, and a CK3 is coupled to a line for CKVB. An IN1 of the SGj is coupled to an OUT1 of a previous stage SGj−1. Here, k is natural numbers excluding 1. An IN2 of the SGj is coupled to an OUT1 of a following stsgeSGj+1. An OUT1 of the SGj is coupled to an IN2 of the SGj−1 and an IN1 of the SGj+1. An OUT2 is coupled to a gate line for Gouti. A power port VSS is coupled to a line for Voff.

In the SG1 without a corresponding previous stage, an IN1 of the SG1 is coupled to a line for STV, and an OUT1 of the SG1 is coupled to an IN1 of the SG2.

In an even number k stage SGk, a CK1 is coupled to a line for CKVB. A CK2 is coupled to a line for CKVB_P. A CK3 is coupled to a line for CKV. On the other hand, an IN1, an IN2, an OUT1, an OUT2 and a power port Vss of the SGk, has same coupling configurations as those of the odd number j stage SGj. Here, k is natural numbers.

Figure 3:
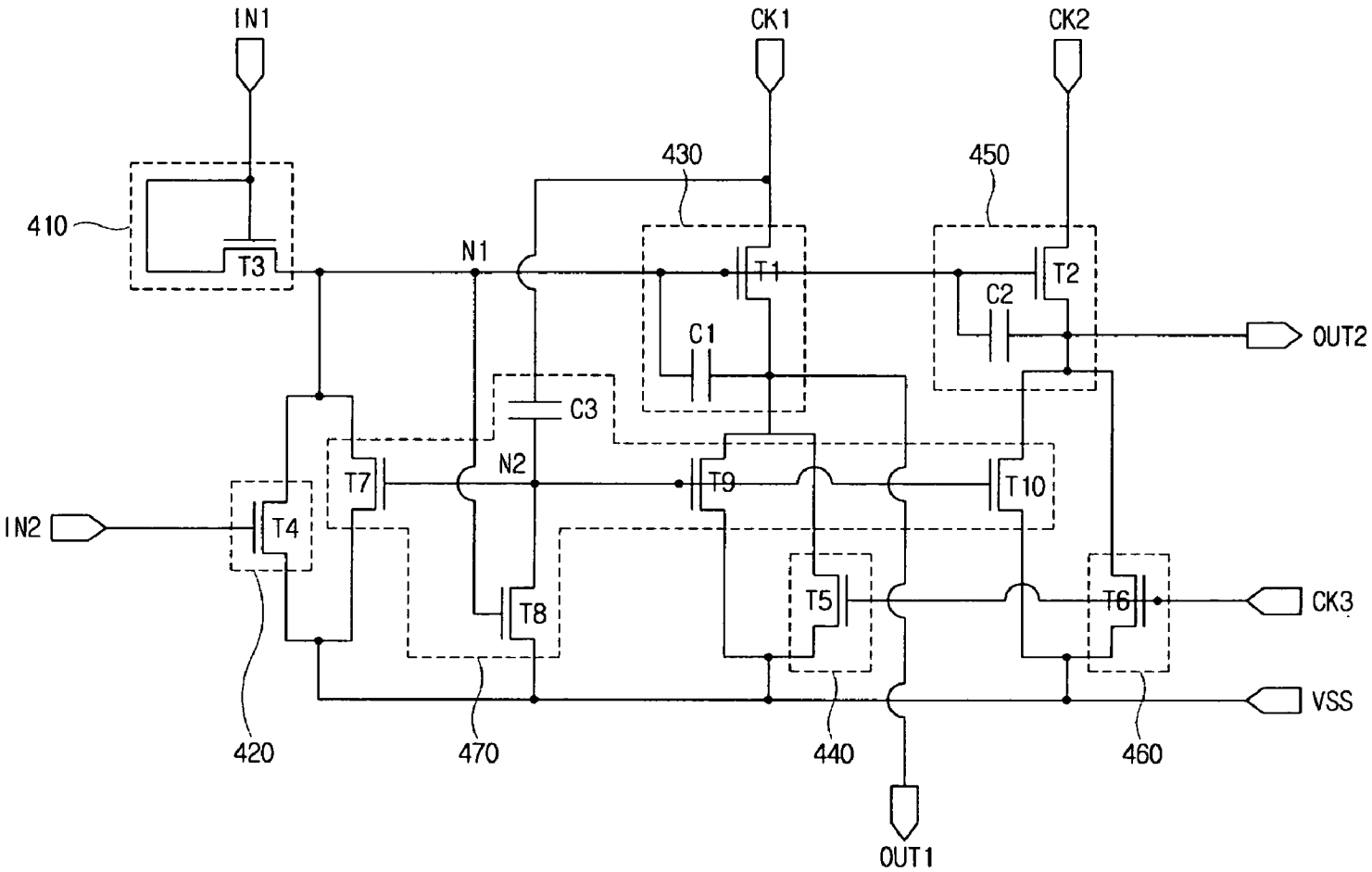
FIG. 3 is a circuit diagram of one of stages in FIG. 2.

In a dummy stage SGn+1 without a corresponding following stage, a first output port OUT1 of the SGn+1 is coupled to an IN2 of the SGn. An OUT2 of the SGn+1 is not provided. In the exemplary embodiment of the present invention, the SGn is initialized by the SGn+1. However, the SGn may be alternatively initialized without the SGn+1 by applying STV to an IN2 of the SGn. Further, according to the exemplary embodiment of the present invention, a shift register is driven by CKV and CKVB. Referring to FIG. 3, according to one embodiment of the present invention, SGi includes a first drive unit 430, 440 to output Ri and Ci to the SGi−1 and the SGi+1 respectively, and a second drive unit 450, 460 to output Gouti, which are provided in parallel to the first drive unit 430, 440. Accordingly, the present inventive concept can be applied to a conventional shift register capable of including the first drive unit 430/440 and the second drive unit 450/460 provided in parallel.

A detailed configuration of the SGi according to the first exemplary embodiment of the present invention is described with reference to FIG. 3.

Every SGi includes a first drive controller 410, a second drive controller 420, the first drive unit 430 and 440, the second drive unit 450 and 460, and a maintenance unit 470. The first drive unit 430 and 440 includes a first pull-up drive unit 430 and a first pull-down drive unit 440. The second drive unit 450 and 460 includes a second pull-up drive unit 450 and a second pull-down drive unit 460.

The first drive controller 410 includes a TFT T3. A drain electrode and a gate electrode of the T3 are commonly coupled to the IN1, and a source electrode thereof is coupled to a node N1. The first drive controller 410 receives Ci of high level from the corresponding previous stage, and applies a first control signal of high level to control ports of the first pull-up drive unit 430 and the second pull-up drive unit 450, respectively.

The second drive controller 420 includes a TFT T4. A drain electrode and a source electrode of the T4 are coupled to the node N1 and the Vss, respectively, and a control port, gate thereof is coupled to the IN2. The second drive controller 420 receives Ri of high level from the corresponding following stage, and applies a second control signal of low level to the control ports of the first pull-up drive unit 430 and the second pull-up drive unit 450, respectively.

The first pull-up drive unit 430 includes a TFT T1 and a capacitor C1. A drain electrode and a source electrode of the T1 are coupled to the CK1 and the OUT1, respectively, and the control port thereof is coupled to the node N1. The capacitor C1 is provided between the control port and the source electrode of the T1. The capacitor C1 may result from the parasitic capacitor between the gate control port and the source electrode of the T1. If necessary, the capacitor C1 may further include a separate capacitor. The first pull-up drive unit 430 selectively outputs CKV or CKVB received at terminal CK1 to the OUT1 according to the first control signal and the second control signal of the first drive controller 410 and the second drive controller 420, to thereby generate Ci of high level and Ri of high level.

The second pull-up drive unit 450 includes a TFT T2 and a capacitor C2. A drain electrode and a source electrode of the T2 are coupled to the CK2 and the OUT2, respectively, and the control port thereof is coupled to the node N1. The capacitor C2 is provided between the control port and the source electrode of the T2. The capacitor C2 may result from the parasitic capacitor between the control port and the source electrode of the fourth TFT T2. If necessary, the capacitor C2 may further include a separate capacitor. The second pull-up drive unit 450 selectively outputs CKV or CKVB inputted from the CK2 to the OUT2 according to the first control signal and the second control signal of the first drive controller 410 and the second drive controller 420, to thereby generate Gouti of high level.

The first pull-down drive unit 440 includes a TFT T5. A drain electrode and a source electrode of T5 are coupled to the OUT1 and the Vss, respectively, and a gate electrode thereof is coupled to the CK3. The first pull-down drive unit 440 selectively outputs Voff inputted from the Vss according to CKVB or CKV applied to CK3 to the first output port OUT1, to thereby generate Ci of low level and Ri of low level.

The second pull-down drive unit 460 includes a TFT T6. A drain electrode and a source electrode of the sixth TFT T6 are coupled to the OUT2 and the Vss, respectively, and a gate electrode thereof is coupled to the CK3. The second pull-down drive unit 460 selectively outputs the Voff inputted from the power port Vss according to CKVB or CKV applied to the CK3 to the OUT1, to thereby generate Gouti of low level.

The maintenance unit 470 includes a TFT T7, a TFT T8, a TFT T9, a TFT T10, and a capacitor C3. A drain electrode and a source electrode of the T7 are coupled to the node N1 and the Vss, respectively, and a control port thereof is couple to a node N2. A drain electrode and a source electrode of the T8 are coupled to the node N2 and the Vss, respectively, and a control port thereof is coupled to the node N1. A drain electrode and a source electrode of TFT T9 are coupled to the OUT1 and the Vss, respectively, and a gate control port thereof is coupled to the node N2. A drain electrode and a source electrode of the T10 are coupled to the OUT2 and the Vss, respectively, and a control port thereof is coupled to the node N2. The capacitor C3 is provided between the CK1 and the node N2. The maintenance unit 470 safely maintains Voff until a gate line is turned on again in a next frame.

In the exemplary embodiment of the present invention, a stage circuit is configured with additional three TFTs and one capacitor to a conventional stage circuit including seven TFTs and two capacitors. In accordance with the foregoing embodiment, a stage drive unit includes: (i) a first drive unit to control a previous stage via a reset signal for Ri and a following stage via a carry signal Ci; and (ii) a second drive unit to output a gate line signal, which are provided in parallel. Accordingly, the stage drive unit can be partially driven. At this time, the present inventive concept can be applied to whatever conventional stage circuit including the first drive unit 430, 440 and the second drive unit 450, 460 connected in parallel.

In the exemplary embodiment of the present invention, the gate driving unit 400 may be formed on a peripheral area of a display substrate while a display cell array circuit is formed, or may be provided as a separate integral circuit and be coupled to the display substrate. Alternately, the gate driving unit 400 may be formed through an additional process in a cell array formation process.

Further, in the gate driving unit 400 according to the exemplary embodiment of the present invention, a TFT, a capacitor, a signal line and the like including their size, and thickness, a length and so on, may be respectively optimized to safely drive the gate driving unit 400. Further, configuration of determining respective locations may be optimized to reduce signal delay or interference at a minimum. For example, in the exemplary embodiment of the present invention, Ci and Ri are signals only for communication between each stage SGi. Accordingly, transistors T1, T5, and T9 may be formed relatively smaller than the T2, T6, and T10. Further, transistors T5 and/or the TFT T6 may be omitted.

Figure 6:
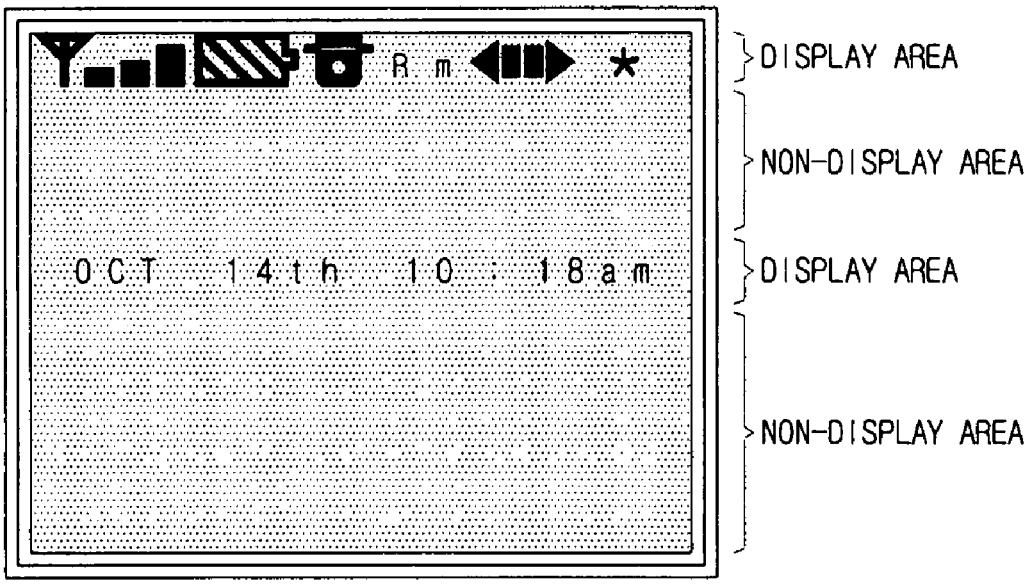
FIG. 6 is an exemplary diagram illustrating a screen display state according to another inputted signal in FIG. 4.

Hereinafter, an operation of the gate driving unit 400 according to the exemplary embodiment of the present invention will be described with reference to FIGS. 4 and 6.

Figure 5:
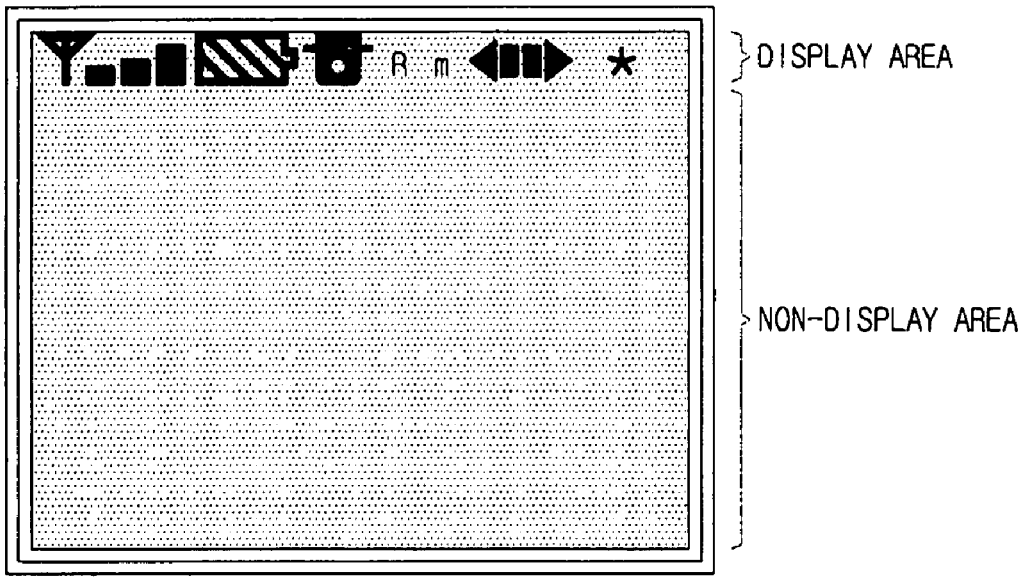
FIG. 5 is an exemplary diagram illustrating a screen display state according to an inputted signal in FIG. 4.

FIG. 4 is a timing diagram of signals inputted into the gate driving unit 400 and the resulting signals Ci, Ri, and Gouti according to the exemplary embodiment of the present invention. FIG. 5 illustrates a display state of a screen according to the inputted signal of FIG. 4. As illustrated in FIG. 4, in a display section I, CKV_P alternately repeats high level and low level with a same phase as CKV, and CKVB_P alternately repeats high level and low level with a same phase as CKVB. In a non-display section II, CKV_P and CKVB_P maintain low level regardless of states of CKV and CKVB.

First, an operation of the gate driving unit 400 in the display section I will be described and then, an operation of the gate driving unit 400 in the non-display section II will be described. It is assumed that all the nodes of all the stage SGi are initially in low-voltage state.

In an 'A' period of the display section I, STV of high level and CKVB of high level are inputted into the SG1 through the IN1 and the CK3, respectively. CKV of low level and CKV_P of low level are inputted into the SG1 through the CK1 and the CK2, respectively. Then, T3 is turned on, to thereby supply a high voltage to the node N1. Also, T5 and T6 are turned on. Accordingly, low Voff is transmitted to the OUT1 and the OUT2, to thereby maintain the low level.

On the other hand, as the high voltage is supplied to the first node N1, T8 is tuned on, to thereby transmit Voff to the node N2. Accordingly, the T7, the T9, and the T10 maintains to be turned off. At this time, since the high voltage is maintained at the node N1, T1 and T2 are turned on, to thereby transmit CKV and CKV_P to the OUT1 and the OUT2, respectively. At this time, since CKV and CKV_P are in low level, CKV and CKV_P do not come into collision with Voff transmitted to the OUT1 and the OUT2 through the T5 and the T6. Thus, the first output port OUT1 and the second output port OUT2 maintains the low level.

At this time, a high voltage and a low voltage are supplied to opposite ends of the C1 and a second capacitor C2, respectively. Accordingly, the capacitor C1 and the capacitor C2 are charged by the corresponding voltage difference. However, same levels of low voltage are supplied to opposite ends of the capacitor C3. Accordingly, the capacitor C3 is not charged.

In the 'A' period, in the SG2, the node N1 maintains the low voltage because the IN1 coupled to the OUT1 of the SGi−1, i.e. the SG1 maintains the low voltage. Accordingly, the T8 is turned off, to thereby maintain a floating state. Since the SG2 belongs to an even number k stage SGk, CKVB is inputted into the CK1, and CKV is inputted into the CK3. Here, k is natural numbers. A voltage of the node N2 in the floating state is synchronized with CKVB by the capacitor C3, and is changed. At this time, in the 'A' period, CKVB is in high level, and CKV is in low level. Accordingly, the T9 and the T10 are turned on, and the T5 and the T6 maintains to be turned off. Further, in the 'A' period, since the node N1 is in the low voltage state, the TFT T1 and the T2 maintains to be turned off. Accordingly, Voff is transmitted to the OUT1 and the OUT2, respectively through the TFT T9 and the T10.

On the other hand, like the SG2, in the SG3, since the IN1 maintains a low voltage, the node N1 maintains a low voltage, and the N2 maintains a floating state. Since the SG3 belongs to an odd number j stage SGj, CKV is inputted into the CK1, and CKVB is inputted into the CK3. Here, k is natural numbers. At this time, in the 'A' period, CKV is in low level, and CKVB is in high level. The low voltage is transmitted to the OUT1 and the OUT2 through the T5 and the T6.

In the 'A' period, a following even number k stage SGk outputs a low voltage through its OUT1 and OUT2 in the same way as the second stage SG2. In the 'A' period, a following odd number j stage SGj outputs the low voltage to the OUT1 and the OUT2 in the same way as the third stage SG3. Here, k is natural numbers excluding 1.

On the other hand, in the 'A' period, since the OUT1 of the second stage SG2 is in the low voltage state, the IN2 of the first stage SG1 maintains the low voltage. Further, in the 'A' period, the T4 of the first stage SG1 maintains to be turned off. Accordingly, STV of high level inputted into the IN1 of the SG1 and the Voff do not come into collision with each other in the node N1.

Hereinafter, the operation of the gate driving unit 400 will be described in a 'B' period of the display section I.

In the SG1, if CKVB and STV is in low level, the T3, the TFT T5 and the TFT T6 are turned off. Accordingly, the node N1 becomes a floating state, and maintains to be in a high voltage state in the 'B' period by the charged capacitors C1 and C2, to thereby allow the T1 and the T2 to maintain to be turned on.

On the other hand, as the node N1 continuously maintains the high voltage, the TFT T8 maintains to be tuned on. Accordingly, the node N2 maintains the low voltage, to thereby allow the T7, the TFT T9 and the TFT T10 to maintain to be turned off. In other word, in the 'B' period, since the T1 and the T2 maintains to be turned on, and the T5, T6, T9, and T10 maintains to be turned off, the OUT1 and the OUT2 output1 CKV and CKV_P of high level converted from low level. Accordingly, in the 'B' period, the OUT2 outputs Gout1 of high level to a first gate line, and the OUT1 outputs C1 of high level to the IN1 of the SGi+i, i.e. the second stage SG2. On the other hand, if the OUT1 and the OUT2 transit to high level, a voltage of higher level is supplied to the node N1 by the capacitor C1 and the capacitor C2. Further, the capacitor C3 is charged by a voltage difference between CKV of high level and the node N2 under the low voltage stage. Thus, the T1 and the TFT T2 maintains to be completely turned on in the 'B' period by a bootstrapping by the capacitor C1 and the capacitor C2.

In the SG2, C1 of high level is inputted into the IN1 coupled to the OUT1 of the stage SG1. CKVB of low level and CKVB_P of low level are inputted into the CK1 and port CK2, respectively. CKV of high level is inputted into the CK3. Accordingly, in the 'B' period, the SG2 is driven in the same way as the SG1. Thus, in the 'B' period, the OUT1 and the OUT2 of the SG2 maintains the low voltage state. The OUT1 and the OUT2 of other SGi maintains the low voltage state in the same way as the 'A' period.

Hereinafter, the operation of the gate driving unit 400 will be described in a 'C' period of the display section I.

The SG2 will be first described for the clarity of description.

Since the second stage SG2 in the 'C' period has the same drive condition as the SG1 in the 'B' period, the SG2 in the 'C' period is driven in the same way as the SG1 in the 'B' period. Accordingly, the OUT1 and the OUT2 of the SG2 in the 'C' period output high levels of C2 and R2, and Gout2.

In the SG1, since R2 of high level is inputted into the IN2 through the OUT1 of the SG2, the T4 is turned on, to thereby allow the low voltage to be supplied to the node N1. Accordingly, the T1, the T2, and the TFT T8 are turned off, and the node N2 becomes a floating state. At this time, since CKV of low level is inputted into the CK1, a voltage supplied between opposite ends of the capacitor C3 becomes 0V, and the node N2 becomes a low voltage state. Accordingly, the T7, the T9 and the T10 maintains to be turned off. On the other hand, since CKVB of high level is inputted into the CK3, the T5 and the T6 are turned on. Accordingly, Voff as the low voltage is transmitted to the OUT1 and the OUT2.

Since the SG3 in the 'C' period has the same drive condition as the SG1 in the 'B' period, the SG3 in the 'C' period is driven in the same way as the SG1 in the 'B' period. Accordingly, the OUT1 and the OUT2 of the SG3 in the 'C' period output C3 and R3, and Gout3 of low levels.

The OUT1 and the OUT2 of the other SGi in the 'C' period maintain the low voltage in the same way as the operation described above until Ci of high level is inputted into the IN1 thereof.

Hereinafter, the operation of the gate driving unit 400 will be described in a 'D' period of the display section I.

In the SG1, since CKV inputted into the CK1 is in high level, a voltage of an end of the capacitor C3 is converted to a high voltage. Accordingly, the T7 is turned on and a low voltage is supplied to the node N1, to thereby the T1 and the T2 maintains to be continuously turned off. Further, the T9 and the T10 are turned on and thus, the low voltage is transmitted to the OUT1 and the OUT2, to thereby allow Gout1 to maintain a low voltage state.

The SG2 is driven in the same way as the SG1 in the 'C' period, and the SG3 is driven in the same way as the SG2 in the 'C' period. The OUT1 and the OUT2 of the other SGi in the 'D' period maintain the low voltage in the same way as the operation described above until Ci of high level is inputted into the IN1 thereof.

On the other hand, in the stage SGi with the OUT1 turned off, the node N1 maintains a low voltage until Ci of high level or STV is inputted into the IN1. A voltage of the node N2 is synchronized with CKV or CKVB inputted from the CK1, and is changed. Accordingly, in an odd number j stage SGj, a low voltage is transmitted to the OUT1 and the OUT2 through the T9 and the T10, respectively if CKV and CKV_P, are in high level, CKVB are in low level. Conversely, if CKV and CKV_P, are in low level, and CKVB are in high level, the low voltage is transmitted to the OUT1 and the OUT2 through the T5 and the T6, respectively. Accordingly, an odd numbered gate line coupled to the OUT2 maintains to be turned off until Ci of high level or STV is inputted into the IN1, and the odd number j stage SGj is turned on again. In an even number k stage SGk, similarly, if CKVB and CKVB_P, are in high level, and CKV is in low level, a low voltage is transmitted to the OUT1 and the OUT2 through the TFT T9 and the T10, respectively. Here, k is natural numbers. Conversely, if CKVB and CKVB_P, are in low level, and CKV is in high level, the low voltage is transmitted to the OUT1 and the OUT2 through the T5 and the T6, respectively. Accordingly, in the same way as the odd numbered gate line, an even numbered gate line coupled to the OUT2 maintains to be turned off until Ci of high level or STV is inputted into IN1, and the odd numbered j stage SG2*j* is turned on again.

In the same way as a description about how each stage in the 'A,' 'B,' 'C,' and 'D' periods is driven, respective other stages in other periods are driven. Accordingly, in the display section I, each stage SGi successively generates a gate signal of high level synchronized with a clock frequency, and applies the generated gate signal to a corresponding gate line.

Next, the operation of the gate driving unit 400 will be described in the non-display section II.

Basically, each stage SGi is driven in the same way as the display section I. However, unlike the display section I, CKV_P or CKVB_P inputted into the CK2 maintains a low level. As illustrated in FIG. 6, a first drive unit 430, 440 controls a following stage SGi+1 and a previous stage SGi−1 based on the SGi. Here, k is natural numbers excluding 1. The second drive unit 450, 460 applies Gouti to a gate line. The first drive unit 430, 440 and the second drive unit 450,460 are connected parallel to be independent of each other. Accordingly, in the non-display section II, each stage is successively turned on in the same way as those in the display section I. However, since CKV_P or CKVB_P inputted into the CK2 maintains the low level, the OUT2 of the respective stages SGi in the non-display section II maintains a low voltage state, to thereby apply no Gouti of high level to the gate line. Thus, display information is not updated and is not displayed on a non-display area of a screen corresponding to the non-display section II.

FIG. 5 is an exemplary diagram illustrating a screen display state in the liquid display device according to the exemplary embodiment of the present invention. In the exemplary embodiment of the present invention, a display area is provided in an upper part of a screen, and a non-display area is provided in a lower part of the screen. However, the display area and an arbitrary number of the non-display area may be formed on ant areas of the screen by changing CKV_P and CKVB_P. FIG. 6 is another exemplary diagram illustrating a screen including two non-display areas and two display areas.

Figure 7:
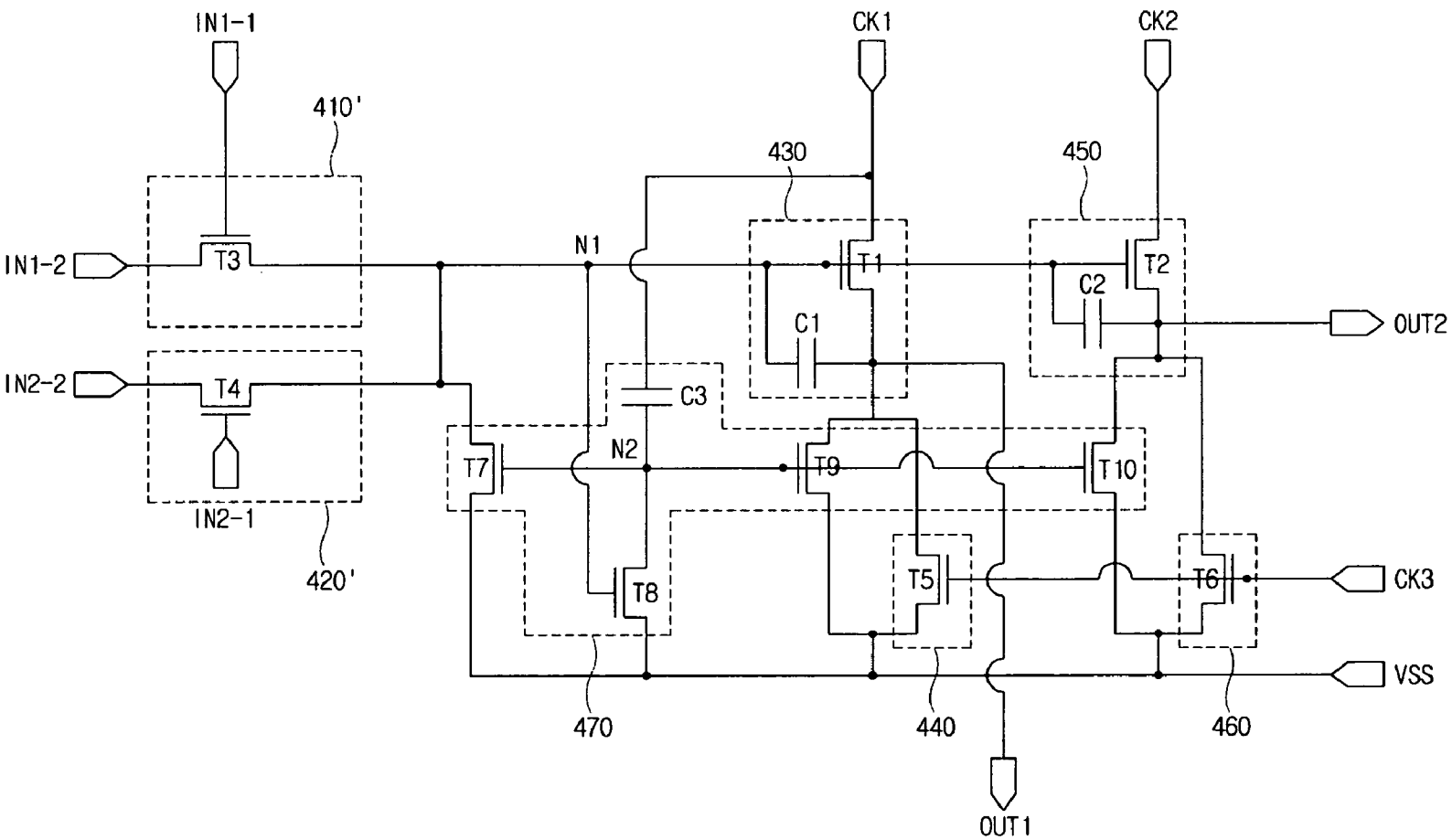
FIG. 7 is a circuit diagram of a stage of a gate driving unit according to a second exemplary embodiment of the present invention.

FIG. 7 is a diagram illustrating a shift register of a gate driving unit of a display device according to a second exemplary embodiment of the present invention.

In this exemplary embodiment of the present invention, a two-direction gate driving unit is provided. Since a configuration in the second exemplary embodiment of the present invention, except a first drive controller 410' and a second drive controller 420', is the same as that in the first exemplary embodiment, only the first drive controller 410' and the second drive controller 420' will be described, and a description for other elements are not repeated. The first drive controller 410' includes a TFT T3, and the second drive controller 420' includes a TFT T4. In a stage SGi', a control port of the T3 is coupled to an output port OUT1 of a previous stage SGi'−1 through an IN1−1, an input port thereof is coupled to an IN1−2, and an output port thereof is coupled to a first node N1. A control port of the T4 is coupled to the OUT1 of the SGk'−1 through an IN2−1, an input port thereof is coupled to an IN2−2, and an output port thereof is coupled to the node N1. At this time, in each SGi' according to the second exemplary embodiment of the present invention, a level of a voltage inputted into the IN1−2 and the IN2−2 is determined according to a drive direction of a gate driving unit. For example, if the SGi' is driven in a downward direction, STV is applied to an SG1', a high level voltage is inputted into the IN1−2, and a low level voltage is inputted into the IN2−2. Conversely, if the SGi' is driven in a upward direction, STV is applied to a last bottom stage, i.e. $n^{th}$ stage SGn', the low level voltage is inputted into the IN1−2, and the high level voltage is inputted into the IN2−2. Since a corresponding operation may be understood without difficulty referring to the first exemplary embodiment, a detailed description for the operation will be omitted.

Below, a method to prevent an afterimage being generated in a non-display area is described.

Figure 8:
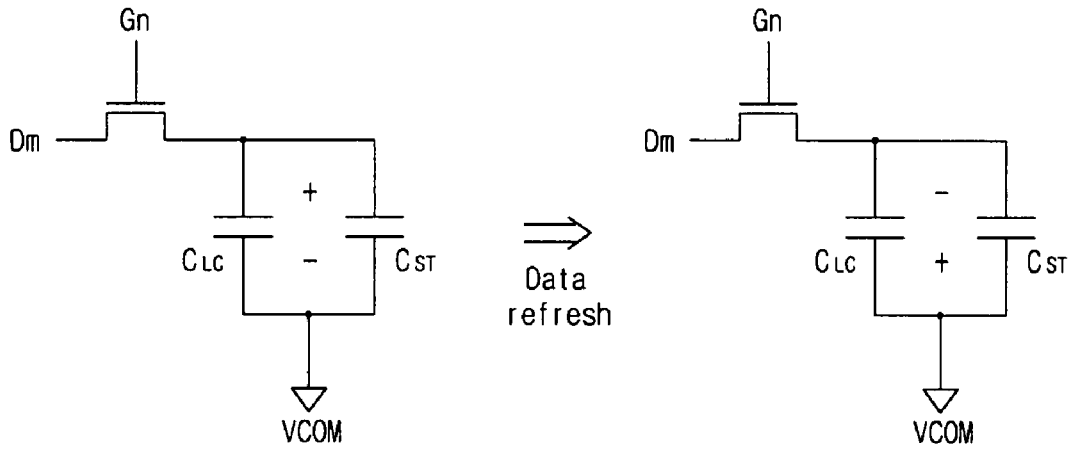
FIG. 8 is a circuit diagram illustrating an operation to update display information of a liquid crystal cell in a non-display area.

In the non-display area, if a liquid crystal capacitor maintains a uniform polarity, an ion provided in a liquid crystal layer is absorbed into a side part of the liquid crystal layer, to thereby generate an afterimage. Particularly, the afterimage may be more easily generated on a non-display area where black color is formed in a normal white color mode. FIG. 8 is a circuit diagram illustrating an operation that updates a voltage to remove the afterimage. Considering the viscosity of liquid crystal, the magnitude of ion polarity in the liquid crystal and the potential difference between opposite ends of a liquid crystal cell, an ion is absorbed in a period of not a few minute but a few hours. Accordingly, as illustrated in FIG. 8, the afterimage can be simply removed by updating a voltage polarity every few minutes. At this time, power consumption for updating of the voltage polarity is negligible. For example, if a liquid crystal panel is driven at 60 Hz and an update of the voltage polarity is performed every 60 minutes, the power consumption for updating the non-display area is calculated as one $3600^{th}$ of the display power consumption area because 1/{60 (frame rate)×60 (second)=1/3600. Accordingly, if a screen is changed from a partial display mode to a full display mode, an afterimage may be removed without substantially increasing the power consumption by updating a voltage of a non-display area.

A voltage update algorithm in a partial display mode and an conversion algorithm from the partial display mode to the full display mode will be described with reference to FIGS. 9 and 10.

Figure 9:
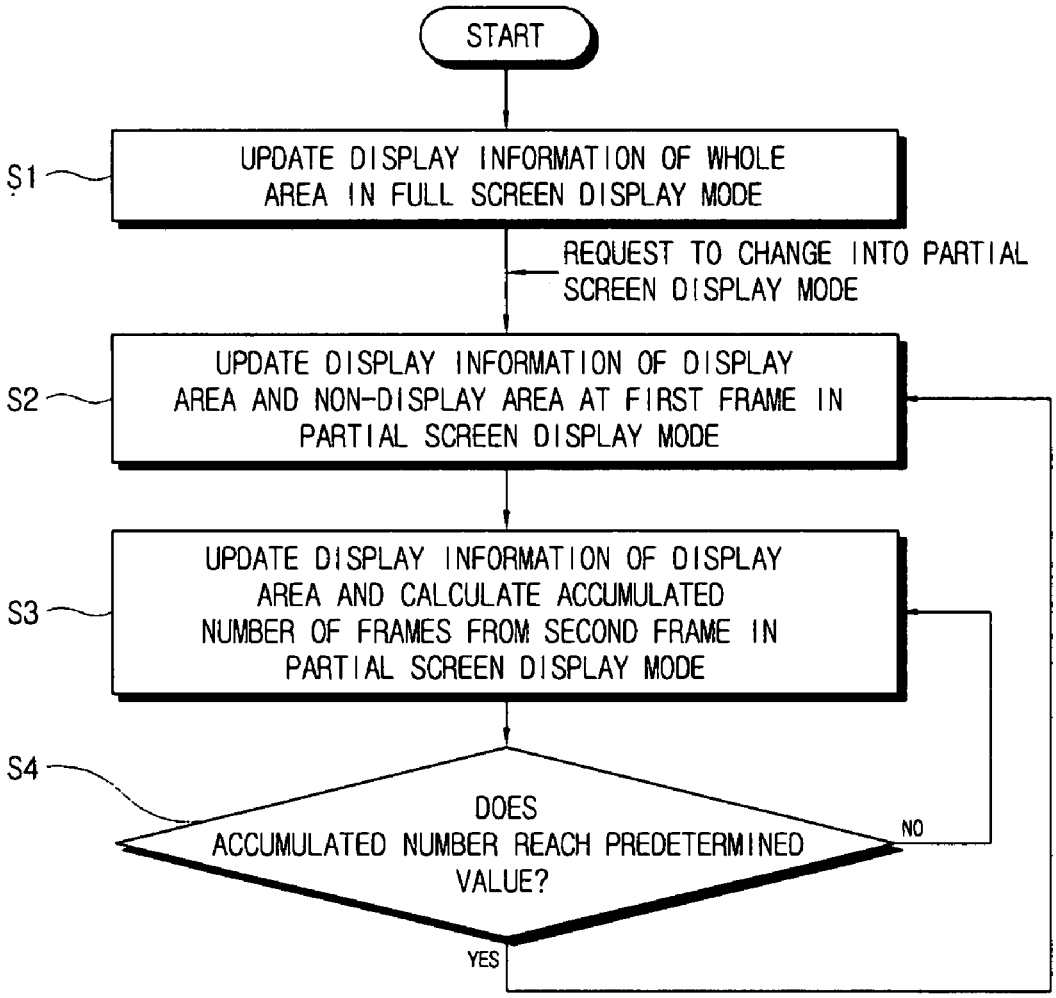
FIG. 9 is a flow chart illustrating a screen display mode change algorithm of a display device according to the first exemplary embodiment of the present invention.
Figure 10:
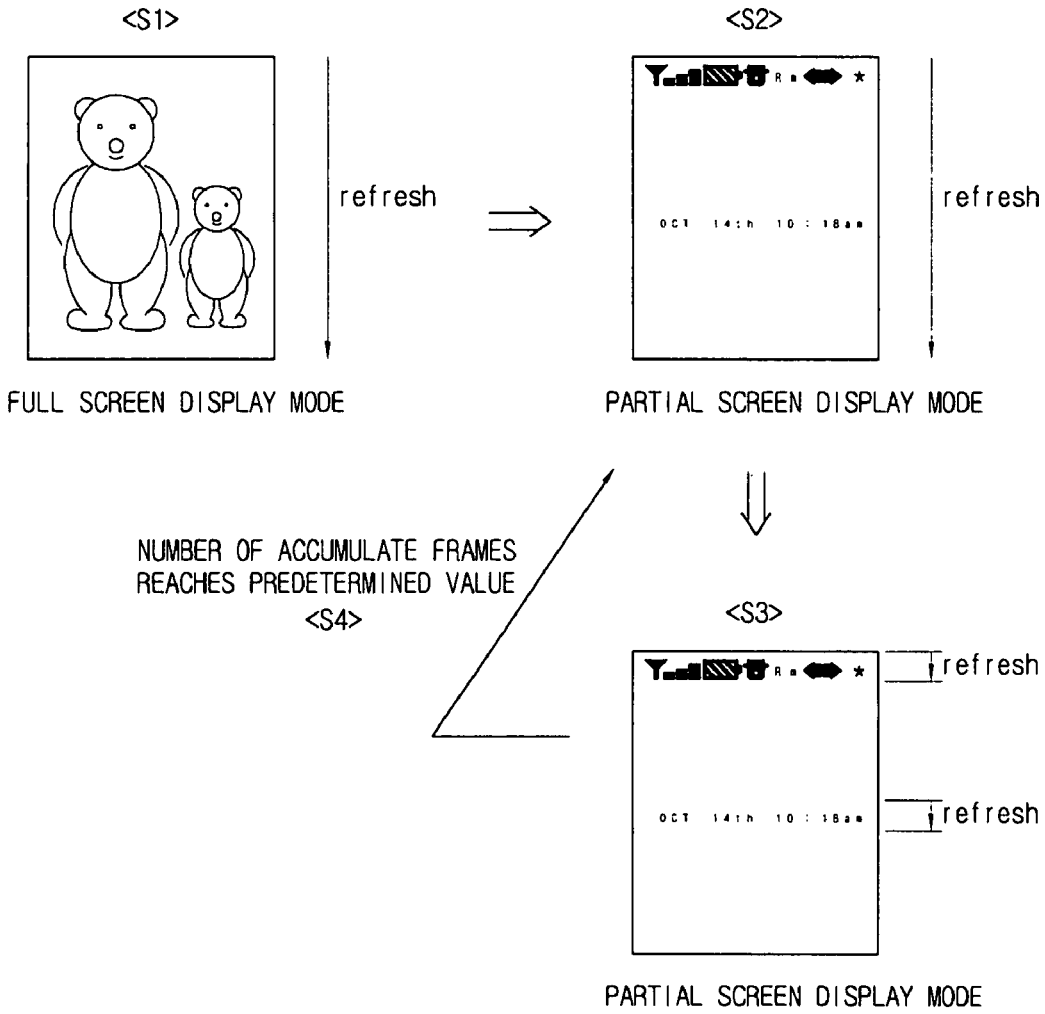
FIG. 10 is an exemplary diagram illustrating a change of a display state if a screen display mode of FIG. 9 is changed.

FIG. 9 is a flow chart illustrating the conversion algorithm converting a screen display mode converting between partial and full display modes, and FIG. 10 is a diagram illustrating a change of the screen according to the screen display conversion algorithm.

First, in a full screen display mode, display information of a whole display area is updated in all frames (S1). If a screen is changed from the full screen display mode to a partial screen display mode, display information related to all pixels of a display area and a non-display area is updated in a first frame of the partial screen display mode (S2). At this time, first display information related to a pixel of the non-display area generally includes black color information. Then, from a second frame of the partial screen display mode, second display information related to a pixel of the display area is updated, and the first display information related to the pixel of the non-display area maintains the display information corresponding to the first frame of the partial screen display mode (S3). At this time, the number of frames is continuously calculated after the screen is changed to the partial screen display mode. If the accumulated number of the frames reaches a predetermined number of frames (for example, 3600 frames) (S4), the display information related to both of the non-display area and the display area, respectively are updated (S2). At this time, the updated second display information related to the display area has a polarity opposite to that of a previous frame, and the updated first display information related to the non-display area also has another polarity opposite to an updated previous display information.

As apparent from the above description, a liquid crystal device according to exemplary embodiments of the present invention can be partially driven to reduce consumption current unlike a conventional amorphous silicon gate structure.

Further, the liquid crystal device according to exemplary embodiments of the present invention can perform a safe drive and form one or more non-display areas having desired sizes on desired positions without constraint.

Although only a few exemplary embodiments of the present invention have been shown and described, it will be appreciated by those skilled in the art in light of the foregoing that changes may be made in these embodiments without departing from the principles and spirit of the present disclosure of invention.

What is claimed is:

1. A display device capable of being operated in a full screen refreshing mode and a partial refreshing mode, the display device comprising:

a display substrate which comprises a gate line and a data line; and a gate driving unit coupled to the gate line of the display substrate, the gate driving unit being operative to provide a gate signal, the gate driving unit comprising a shift register having a plurality of stages sequentially connected one to the next, wherein at least one of the stages comprises:

first and second clock input ports separated from each other and configured to respectively receive a first clock signal and a second clock signal, where the second clock signal is a partial clock signal;

first and second control input ports, the first control input port being connected to a previous stage among said sequentially connected stages and the second control input port being connected to a next stage;

first and second output ports;

a first drive controller that is configured to generate a first control signal responsive to a carry signal received from the previous stage by way of the first control input port, a second drive controller that is configured to generate a second control signal responsive to a reset signal received from the next stage by way of the second control input port, a first drive unit, operatively coupled to the first output port, to the first clock input port and that is configured to output a respective reset signal to the previous stage by way of the first output port and to output a respective carry signal to the following stage also by way of the first output port and in response to the first control signal generated by the first drive controller and the first clock signal received by way of the first clock input port, and a second drive unit, operatively coupled to the second output port, to the second clock input port and that is configured to output a respective gate signal to the gate line by way of the second output port and in response to the first control signal generated by the first drive controller and the partial clock signal received by way of the second clock input port.

2. The display device according to claim 1, wherein the second drive controller is configured to receive by way of the second control input port a gate off voltage level which is at times also applied to the gate line and where the second drive controller is further coupled to a first node (N1) within the at least one stage, to which first node the second drive controller selectively applies the second control signal in response to a reset signal being received by the second control input port.

3. The display device according to claim 1, wherein the first drive unit comprises a first pull-up drive unit which is configured to generate a respective carry signal of high level and a respective reset signal of high level, and a first pull-down drive unit which is configured to generate a respective carry signal of low level and a respective reset signal of low level.

4. The display device according to claim 3, wherein the first pull-up drive unit further comprises a first capacitor coupled between the first node and the first output port.

5. The display device according to claim 3, wherein, in addition to the first and second clock input ports, the at least one stage includes a third clock input port, the third clock input port being connected to receive an inversion clock signal, and wherein the first pull-down drive unit comprises a current sinking node to which a gate off voltage is inputted, a control port connected to the third clock input port so as to receive the inversion clock signal, and an output port which selectively outputs the gate off voltage in response to the inversion clock signal.

6. The display device according to claim 1, wherein the second drive unit comprises a second pull-up drive unit configured to generate during the partial refreshing mode, a gate signal of high level in a partially refreshed portion of the screen and a gate signal of low level in a portion of the screen that is not being partially refreshed, and a second pull-down drive unit which is configured to generate the gate signal of low level in both of the partially refreshed portion and not being partially refreshed portions of the screen during the partial refreshing mode.

7. The display device according to claim 6, wherein the second pull-up drive unit further comprises a second capacitor which is coupled to the second output port.

8. The display device according to claim 6, wherein the second pull-down drive unit comprises an input port into which a gate off voltage is inputted, a control port to which an inversion clock signal is applied, and an output port which outputs the gate off voltage inputted into the input port by the inversion clock signal applied to the control port.

9. A driving method of driving a display device so as to allow for operating in a full screen refreshing mode and a partial screen refreshing mode, the method comprising:

providing to a first drive controller within a corresponding one of sequentially connected shift register stages, a carry signal from a previous stage, the first drive controller being operative to generate a first control signal;

operating a first pull-up drive unit within the corresponding one stage to source a first sourcing signal derived from a first clock signal supplied to a first clock input port of the one stage and in response to the first control signal, the first sourcing signal operating as a respective carry signal output through a first output port of the one stage, and operating a second pull-up drive unit within the corresponding one stage to source a second sourcing signal derived from a second clock signal supplied to a second clock input port of the one stage, the second clock input port being separated from the first clock input port and the second clock signal being a partial clock signal, the operating a second pull-up drive unit being in response to the first control signal, the second sourcing signal operating as a respective gate signal output through a second output port of the one stage;

operating a second drive controller to receive a reset signal from a following stage and to generate a second control signal; and preventing the clock signal from being transmitted to the first output port in response to the second control signal and allowing a pull-down drive unit to output a gate off voltage to the first output port, and preventing the partial clock signal from being transmitted to the second output port in response to the second control signal and allowing a second pull-down drive unit to output the gate off signal to the second output port.

* * * * *